United States Patent [19]

Mayfield

[11] Patent Number: 4,651,837

[45] Date of Patent: Mar. 24, 1987

[54] DOWNHOLE RETRIEVABLE DRILL BIT

[76] Inventor: Walter G. Mayfield, #8 Farnham Park, Houston, Tex. 77024

[21] Appl. No.: 615,932

[22] Filed: May 31, 1984

[51] Int. Cl.[4] ..... E21B 10/66

[52] U.S. Cl. ..... 175/262; 175/261; 175/272

[58] Field of Search ..... 175/258, 260, 261, 263, 175/272

[56] References Cited

U.S. PATENT DOCUMENTS

| | | | |
|---|---|---|---|
| 1,454,984 | 5/1923 | Stewart | 175/260 |
| 1,819,798 | 8/1931 | Stokes | 175/261 |
| 1,978,119 | 10/1934 | Walker | 175/261 |
| 2,173,018 | 9/1939 | Hurley | 175/261 |
| 3,306,377 | 2/1967 | Johnson | 175/261 |
| 3,369,618 | 2/1968 | Moore | 175/104 |
| 3,554,304 | 1/1971 | Link et al. | 175/259 |
| 3,661,205 | 5/1972 | Belorgey | 166/65 R |
| 3,880,247 | 4/1975 | Harding | 175/260 |
| 3,901,331 | 8/1975 | Djurovic | 175/171 |

OTHER PUBLICATIONS

Drilling & Casing Operations Handbook (pp. 88–93).
History of Oil Well Drilling (pp. 1060–1070).

*Primary Examiner*—James A. Leppink
*Assistant Examiner*—William P. Neuder
*Attorney, Agent, or Firm*—Arnold, White & Durkee

[57] ABSTRACT

A rotary well-drilling bit lowered through a drill string to a special orienting, positioning and aligning sub attached to the bottom of the drill string with the aid of mud pressure with the bit approximately 90° from its normal operating position. The drill bit is prepositioned before entering the drill string and utilizes a drill bit positioning means to properly orient and position the drill bit at the bottom of the borehole. Once properly positioned and oriented, a wireline attached motor turns an assembly shaft which raises the drill bit into its bit receptacle. Removal of the drill bit is accomplished by relowering the wireline attached motor and turning the assembly shaft to loosen the shaft from the drill bit and raising the wireline, wireline motor, assembly shaft and drill bit through the drill string.

27 Claims, 8 Drawing Figures

DOWNHOLE RETRIEVABLE DRILL BIT

BACKGROUND OF THE INVENTION

In rotary drilling of boreholes, the usual practice is to use a rotary drilling bit which is secured to the lower end of a drill string. Dulling of the drill bit requires retrieving the entire drill string, replacing the dull bit with a new or rebuilt bit, and then relowering the entire drill string into the borehole. This is a relatively slow and costly operation, due in large part to the time consumed in uncoupling and subsequently recoupling sections of the drill pipe. Moreover, the time and costs increase as the depth of the hole increases. The costs become even greater in offshore drilling, in view of the very high hourly rates involved in operating offshore drilling platforms and drilling vessels.

It has been proposed to avoid the expense of raising and lowering an entire drill string by providing a drill bit of a type that can be installed and retrieved directly through the drill string. When the drill bit is dull, the bit would be replaced without withdrawing the entire drill string. Attempts at this approach, however, have not been successful since the drill bit cutters have been relatively small, thereby placing limitations on the diameter of the hole which they can drill effectively. The small size of the bits is due, in part, to the fact that the inside diameter of the drill string is relatively small. The largest inner diameter of a conventional drill string is around 4 inches.

The prior art has described several types of retrievable drill bits. None of these bits, however, have satisfactorily dealt with the operating conditions encountered while drilling a borehole. These conditions include tremendous forces which act on a bit while drilling. These forces may vary depending on bit surface area, type of formation being drilled, friction and heat. In improperly designed bits, these forces can be transferred onto members which cannot withstand the forces. The structural design of drill bits is therefore extremely important; otherwise, large drilling load forces may be centered on a few small parts which are vital to keeping the bits from breaking off or otherwise becoming inserviceable. This has been a particular problem with retrievable bits of the prior art.

Drilling rig operators shy away from drill bits which may break off in a borehole, because of the problems and costs encountered in fishing small pieces of drill bit out of the borehole. They also shy away from bits which are unreliable in their performance. Retractable drill bits in the prior art have failed to produce a reliable mechanical method of locking a drill bit into its normal operating position and thereafter retrieving the bit. Methods of retrieving and locking retrievable drill bits must be reliable and both the methods and the bits must be able to withstand the vibrations, forces and heat that are encountered in the drilling environment.

DESCRIPTION OF THE PRIOR ART

U.S. Pat. No. 3,306,377 describes a retractable bit with a downwardly converging, generally conical casting or bulbous body with a bottom point which corresponds to the center of a borehole. Several vertically disposed, wedge-shaped bit segments are pivotally mounted at the bottoms of the bulbous body. The package of bit segments is lowered down through a drill string and expanded into drilling position below the drill string. Retrieval of the bit is accomplished by retracting the bit segments into a package and pulling the package up the drill string.

U.S. Pat. No. 3,369,618 describes a retrievable drill which comprises a pair of conical cutters powered by a downhole motor. The cutters dangle side by side within a drill string below the motor. When lowered below the drill string, they are centrifugally spun into drilling position by the motor. It is possible to load the cutters by transmitting weight from the drill string indirectly to the cutters. The cutters, however, are necessarily small.

U.S. Pat. No. 3,554,304 describes a complex retractable drill in which three diamond-type drill segments are nested one above the other in a special sub at the lower end of a drill string. The sub has guides which orient and assemble the cutters as they are lowered into drilling position below the drill string. The bit is retrieved by retracting the bit segments sequentially back into the special sub.

U.S. Pat. No. 3,880,247 describes a retrievable drill bit which employs two central, fixed, conical cutters and two expansible conical cutters. All of the cutters are necessarily small to fit inside the drill pipe. The small size translates to mechanical weakness.

SUMMARY OF THE INVENTION

It is a general objective of the present invention to provide an improved rotary drill bit which is capable of being lowered and removed through a drill string. A further objective is to provide a bit which does not require the assembly and disassembly of a plurality of bit segments. A still further objective is to provide a bit which is retrievable, but which is also simple and rugged, and capable of withstanding heavy drilling loads.

The drill bit of the invention comprises a one piece drill bit which can be raised and lowered within a drill string, and which can be positively positioned and locked into its normal operating position in a receptacle located at the bottom of a special sub or hollow tubular or cylindrical means. This sub is attached to the lower end of a drill string. Drilling loads can thereby be transmitted directly from the drill string to the drill bit. The drilling surface of the bit is generally flat and has one transverse dimension sufficient to span the diameter of the borehole to be drilled.

It has a second transverse dimension which enables it to fit and move within and along the drill string. The bit is designed to translate from a first orientation with the drill string to a second drilling orientation upon emerging from the bottom of the drill string. In the latter orientation, the bit positively engages the drill string so as to be rotated and loaded from the drill string.

This invention possesses many advantages which will become more clearly apparent from a consideration of a form in which it may be embodied. This form is shown in the drawings which accompany and form a part of the present specification. It will be understood that the description of this embodiment is merely illustrative, and is not to be taken in a limiting sense.

DESCRIPTION OF THE PREFERRED EMBODIMENT

Figure 1:
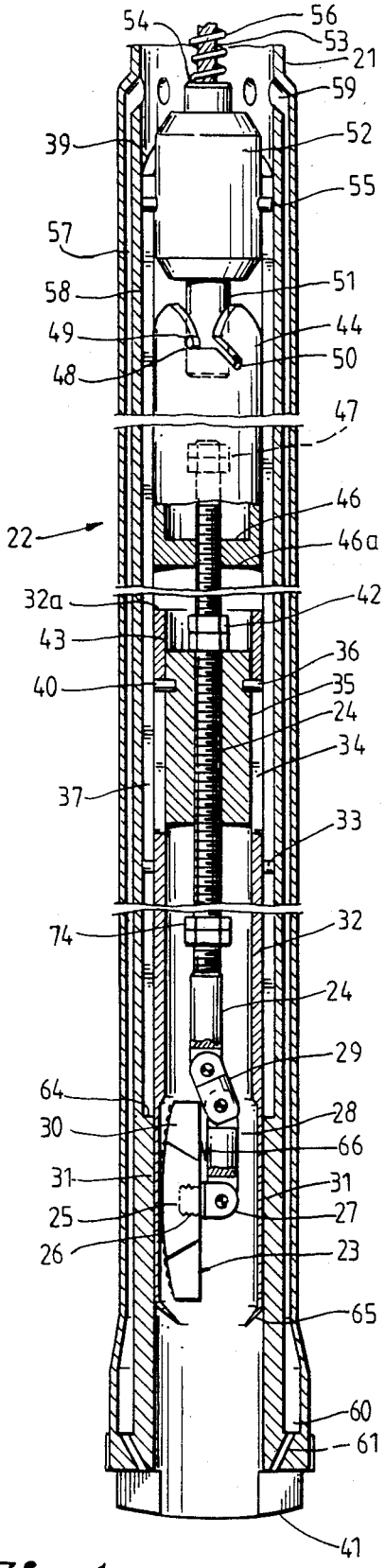
FIG. 1 is an elevational view, partially in section, of a downhole retrievable drill bit being lowered into position.

The specific downhole retrievable drill bit illustrated in the drawings is retrievable as a unit through a drill string 21 between a drilling rig and the bottom of the borehole. The drill bit is movable through the drill string 21 and the special hollow tubular or cylindrical member 22 attached to the lower portion of the drill pipe. Before commencing the operation of lowering the drill bit assembly through the drill string 21, the drill string 21 is raised from the borehole bottom.

As illustrated in FIG. 1 the drill bit 23 is lowered down the drill string 21 and special hollow tubular or cylindrical member or sub 22 in a position approximately 90° from its normal drilling position. The drill bit 23 is attached to the bottom of the assembly shaft or rod 24 by means of the threaded member 25 which threads into the threaded hole 26 in drill bit 23. The drill bit 23 has cutting surfaces similar to cutting surfaces commonly known in the art, such as a diamond faced bit or a fishtail and drag bit. The threaded member 25 is pivotally attached by pivot device 27 to the bottom of offset mechanism 28. One end of offset mechanism 28 is pivotally attached to offset mechanism 29. Offset mechanism 29 enables oversized drill bit 23 to be lowered down the restricted inner diameter of the drill string 21 and the hollow tubular or cylindrical member or sub 22 by offsetting the center line of the bottom of offset mechanism 28 from the center line of assembly shaft 24. The offset mechanism 29 is attached to the bottom of assembly shaft 24a and thenceforth to the assembly shaft 24.

The top edge 30 of drill bit 23 snugly fits against the side of offset mechanism 29 thereby enabling an oversized drill bit to be properly accommodated in the inside diameter of the drill string 21 and the inside diameter of the hollow tubular means 22 while the drill bit 23 is lowered into position.

Drill bit 23 is held in its vertical position, approximately 90° from its normal operating position, by means of the thinner wall section 31 of the positioning device 32. The drill bit is transported down the drill string 21 and hollow tubular or cylindrical member 22 and restrained by the thinner wall section 31 of the positioning device 32.

Positioning device 32 consists of a hollow tubular member with an outside diameter complementary matching the inside diameter of hollow tubular or cylindrical member 22, with drill bit positioning studs 33, longitudinal slots 34, a captive threaded sleeve 35, thinner wall section 31, and rubber tip 65. The captive threaded sleeve 35 consists of a cylindrical body with an outside diameter complementary matching the inside diameter of the positioning device 32, threads to interengage assembly shaft 24 and has protruding counterrotation studs 36 which interengage the longitudinal slots 34. The two drill bit positioning studs 33 on the positioning device 32 are located 180° apart. The two longitudinal slots 34 in the positioning device 32 are located 180° apart and 90° from the drill bit positioning studs 33.

The drill bit positioning studs 33 interengage the slots or grooves 37 which are an integral part of the special hollow tubular or cylindrical member 22. The studs 33 are guided into the grooves or slots 37 by means of a unique and innovative method depicted in FIGS. 1 and 2. The groove or slot walls 37 are machined in a fashion such that the groove or slot walls slope to an apex 38 resulting in a gradual sloping wall 39. The apex 38 is rounded at the highest point, thereby enabling a positioning stud 33 to come in contact with either the apex 38 or the sloping walls 39. This guide means thereby enables stud 33 to be gradually and uniformly guided into the slot or groove 37 and thereby positively positioned and inserted into the drill bit positioning stud 33 of the drill bit positioning device 32 into the slot or groove 37.

The drill bit 23 is lowered down drill string 21 and hollow tubular or cylindrical member 22 with the threaded sleeve counterrotation studs 36 against the top end 40 of the longitudinal slots 34. The proper orientation of drill bit 23, to facilitate proper positioning and placement in the bit receptacle 41, is facilitated by means of the locking nuts 42 located on the threaded assembly shaft at the top surface 43 of the threaded sleeve 35.

The drill bit is positioned by means of a positioning jig, and once the proper orientation of the drill bit is established, locking nuts 42 are tightened against the top surface 43 of the threaded sleeve 35. The proper orientation of the drill bit is thereby assured, as the entire assembly travels down the drill string 21 and hollow tubular or cylindrical member 22.

The drill bit is lowered down drill string 21 and hollow tubular or cylindrical member 22 by means of a slotted wireline attachment sleeve 44. Lowering of the drill bit assembly through the drill string 21 and hollow tubular or cylindrical member 22 is partially aided by mud flow down through the center of the drill string 21. This flow of mud aids in pushing and assisting the downward travel of the drill bit assembly.

Wireline attachment sleeve 44 consists of a hollow rotating sleeve with an outside diameter complementary matching the inside diameter of hollow tubular or cylindrical member 22, and a threaded bottom 46 threadedly engaging the assembly shaft or rod 24. The slotted wireline attachment sleeve 44 is held captive in the assembly shaft or rod 24 by means of the end of shaft stop 47. The slotted wireline attachment sleeve 44 includes two groove or slot sets. One set of grooves or slots designated lowering and positioning slots 48 are utilized to interengage the wireline operating shaft studs 49 during the lowering of the downhole retrievable drill bit. The second set of slots designated lifting and retrieval slots 50 interengage the wireline motor operating shaft studs 49 to lift the downhole retrievable drill bit out of the hollow cylindrical member 22 and the drill pipe 21.

The wireline operating shaft studs 49 protrude from the wireline motor operating shaft 51. Shaft 51 is driven or rotated in either a clockwise or counterclockwise rotation (as viewed from the top of the motor looking downwards) by the wireline motor 52. The wireline motor is attached to the wireline 53 at wireline attachment point 54. As the wireline 53 lowers the wireline motor and the attached retrievable drill bit assembly down drill string 21 and the hollow tubular or cylindrical member 22, the wireline motor counterrotation studs 55 are guided by the groove or slot apex 38 and the sloping walls 39 into the slot or groove 37. The groove or slot 37 prevents rotation of the wireline motor case 52, whenever the wireline motor shaft 51 is rotated in either a clockwise or counterclockwise method. The wireline motor 52 is energized by means of electrical cable 56 which is threaded to wire-line 53 in a spiral fashion. The wireline motor 52 may either be a DC or AC powered motor. In the alternative, the electrical conductors utilized to energize the wire-line motor 52 may be an integral part of wireline 53.

In the alternative a hydraulic motor may be used in lieu of an electrical motor in which case the hydraulic lines are spirally wrapped around the wireline or form an integral part of the wireline.

In any event, however, the motor should be capable of reverse rotation at the operator's discretion at the top of the drilling rig.

Figure 8:
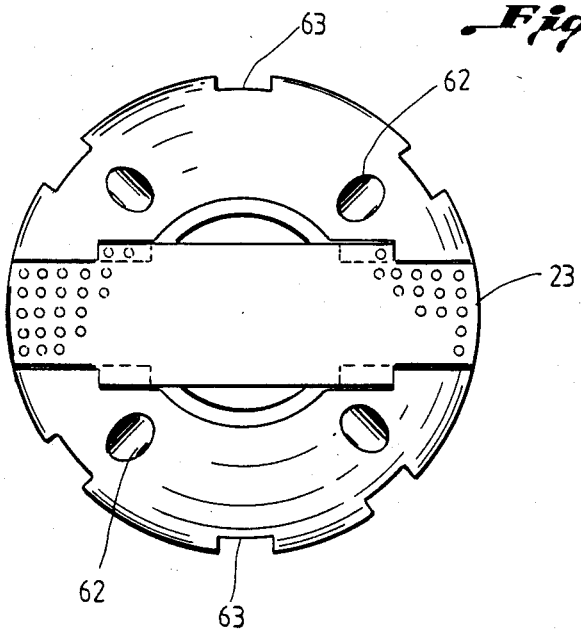
FIG. 8 is a bottom view of a downhole retrievable drill bit in its normal drilling position, taken in a cross-section along line 8—8 of FIG. 3.

Drilling mud is circulated to the bottom of the drill bit to aid in the lubrication of the drill bit during drilling, and to aid in the removal of debris loosened by the drilling operation. The mud flows through an annular passageway or mud jacket 57 defined by a ring formed in the inner walls of hollow cylindrical or tubular member 22. The mud jacket 57 is provided with mud inlets 59. As the mud is pumped down drill string 21, it enters the mud inlets 59 and travels down around the mud jacket 57. As the mud reaches the bottom of the mud jacket 60, it enters the mud jets 61. The mud entering mud jets 61 exits the mud ports 62 illustrated in FIG. 8. To aid in the mud flow around the outer circumference of bit receptacle 41, slots 63 are cut in the outer circumference of bit receptacle 41 as illustrated in FIG. 8. It is to be understood that drilling mud may be pumped down the drill pipe 21 and into mud inlets 59 and out of mud ports 62 and back up mud slots 63; or in the alternative, the drilling mud may be pumped down the outer circumference of drill pipe 21 through mud slot 63 with mud ports 62 being utilized as a return path for the drilling mud. In that event the mud would flow through mud jets 61 into the bottom of the mud jacket 60, through mud jacket 57, out of mud ports 59, and up drill string 21.

Figure 2:
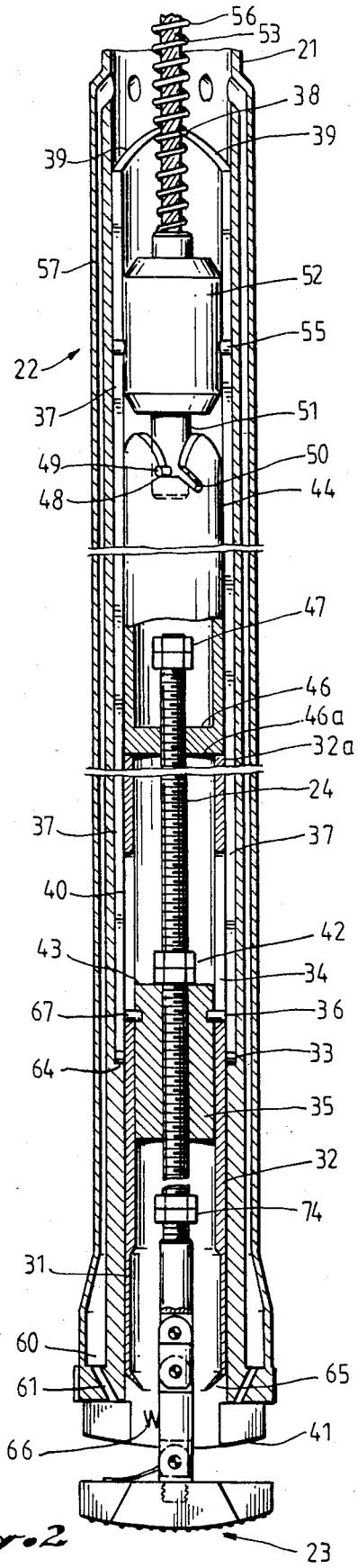
FIG. 2 is an elevational view, partially in section, of the downhole retrievable drill bit at the bottom of bit travel, but before it has been locked in a drilling position.

As the downhole retrievable drill bit assembly is lowered down the drill string 21 and the hollow tubular or cylindrical member 22, the drill bit positioning studs 33 are guided by apex 38 and sloping walls 39 into the positioning grooves or slots 37. As the positioning device 32 travels down the grooves or slots 37, the wireline motor counterrotation studs 55 are guided by apex 38 and sloping walls 39 into the positioning slots or grooves 37. The downhole retrievable drill bit assembly travel continues until reaching the bottom 64 of groove or slot 37. Thereafter the drill bit 23 continues to travel until counter-rotation studs 36 reach the bottom 67 of longitudinal slots 34. (Referring to FIGS. 1 and 2.) As counter-rotation studs slide from the top 40 of longitudinal slots 34 to the bottom 67 of longitudinal slots 34 the drill bit 23 slides out of the thinner section 31 of positioning device 32 and is partially propelled, to a position whereby the bit 23 is alligned to be received into bit receptacle 41, by the bias means 66 and also partially by the mud flow down the center of the drill string 21. At that point drill bit 23 has penetrated the bit receptacle 41 and the bit 23 axis is approximately normal to the assembly shaft axis as illustrated in FIG. 2.

Drill bit 23 has been oriented to fit into receptacle 41 by means of the positioning device 32 and the locking nuts 42 tightened against threaded sleeve surface 43. As positioning studs 33 makes contact with the bottom 64 of slot or groove 37, drill bit 23 slides out of the thinner section 31 of positioning device 32 (illustrated in FIG. 2) past the flexible rubber tip 65. The downward travel of drill bit 23 continues until surface **46*a*, at the bottom of hollow rotating sleeve 44, makes contact with surface 32*a*, at the top portion of positioning sleeve 32. Bit 23 is also urged into a position normal to the assembly shaft axis by a bias means or resilient member 66. Bias means or resilient member 66** may be any suitable resilient member such as a spring.

Once drill bit 23 has been urged to a position approximately a position whereby the drill bit 23 axis is normal to the axis of the assembly shaft or rod 24, seating of the bit 23 into bit receptacle 41 may be partially aided by lowering the drill string 21 onto bit 23 thereby urging bit receptacle 41 onto bit 23. The bit 23 is locked in position by rotating the hollow rotating sleeve 44 in a clockwise direction (as viewed from the top looking down) about assembly shaft or rod 24. Hollow rotating sleeve 44 threadedly engages the assembly shaft 24 threads. This threaded engagement of assembly shaft 24 further pulls bit 23 upwards into bit receptacle 41. Assembly shaft 24 is prevented from rotating while hollow rotating sleeve 44 is rotated by means of locking nuts 42 bearing against top of threaded sleeve surface 43 of threaded sleeve 35. Threaded sleeve 35 is prevented from rotating while hollow rotating sleeve 44 is rotated by means of counter-rotation studs 36 positioned in longitudinal slots 34 of positioning device 32. Positioning device 32 is prevented from rotating while hollow rotating sleeve 44 is rotated by means of positioning studs 33 interengaged in grooves or slots 37. As rotation of hollow rotating sleeve 44 continues, counterrotation studs 36 travel from the bottom 67 of longitudinal slots 34 upwards towards the top 40 of the longitudinal slots 34. As threaded sleeve 35 moves from the bottom 67 of longitudinal slots 34 upwards towards the top 40 of longitudinal slots 34, the drill bit 23 is raised into its normal drilling position and locked into bit receptacle 41. Once bit 23 is received into bit receptacle 41, its normal drilling position, hollow rotating sleeve 44 holds shaft 24 in tension which holds bit 23 in its normal drilling position. Once bit 23 is received and locked in bit receptacle 41 the further rotation of hollow sleeve 44 is prevented by top of positioning sleeve 32a bearing against bottom surface 46 of hollow rotating sleeve 44.

A unique and innovative aspect of this invention is the "upside-down Tee shaped" member formed by the drill bit and the assembly shaft with the bit in its normal operating position. The drill bit upper surface is sloped to match complimentary matching sloped surfaces on the bit receptacle 41. These matching sloped surfaces as well as the shape of the drill bit aid in the proper alignment and positioning of the drill bit. Additionally the drill bit configuration minimizes forces normally concentrated on small surface areas by increasing the load bearing surface areas and thereby reducing the loads per unit area.

As wireline motor operating shaft 51 rotates in a clockwise direction (as viewed from the top looking down), the wireline motor 52 is prevented from rotating by the counterrotation studs 55 held captive by grooves or slots 37.

Figure 3:
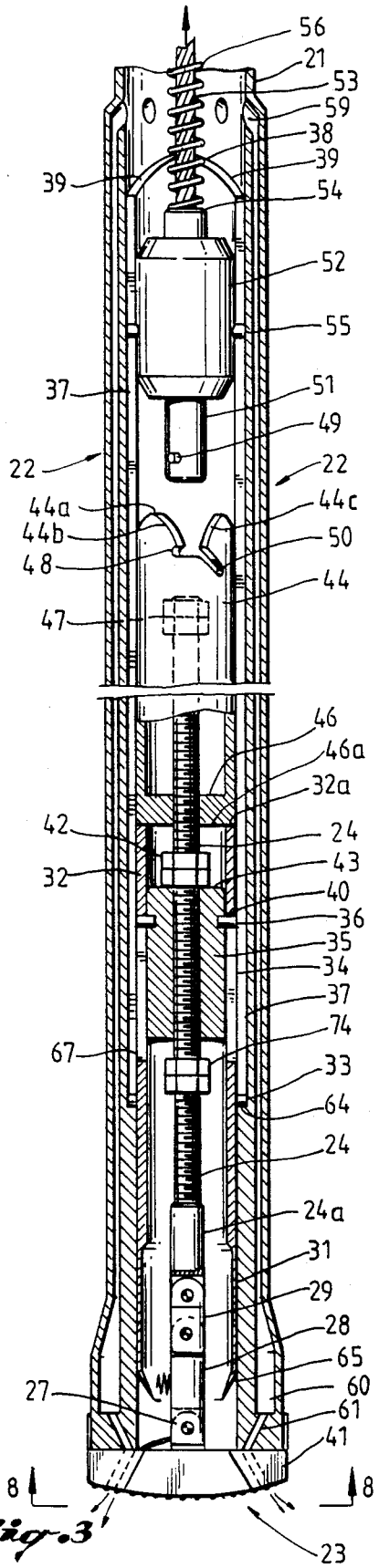
FIG. 3 is an elevational view, partially in section, of the downhole retrievable drill bit in its normal drilling position.

FIG. 3 illustrates drill bit 23 in its normal operating position locked into bit receptacle 41. Proper positioning and seating of the drill bit 23 in bit receptacle 41 may be detected by means of a microswitch in the bit receptacle. The microswitch status is sensed by a wireline carrier wires lowered with the wireline motor. Assembly shaft 24 is held in tension by assembly shaft 24 threadedly engaging hollow rotating sleeve 44 therbey urging hollow rotating sleeve 44 downward causing surface 46a of hollow rotating sleeve 44 to bear against surface 32a of positioning device 32 resulting in a downward force on positioning device 32.

The downward forces acting against positioning device 32 are transmitted to positioning studs 33 which are in turn resisted and opposed by bottom of slot or groove 64. With assembly shaft 24 held in tension as described above bit 23 is locked in its normal drilling position in bit receptacle 41. The tension on assembly shaft 24 is maintained by refraining from any further rotation of assembly shaft 24.

Figure 7:
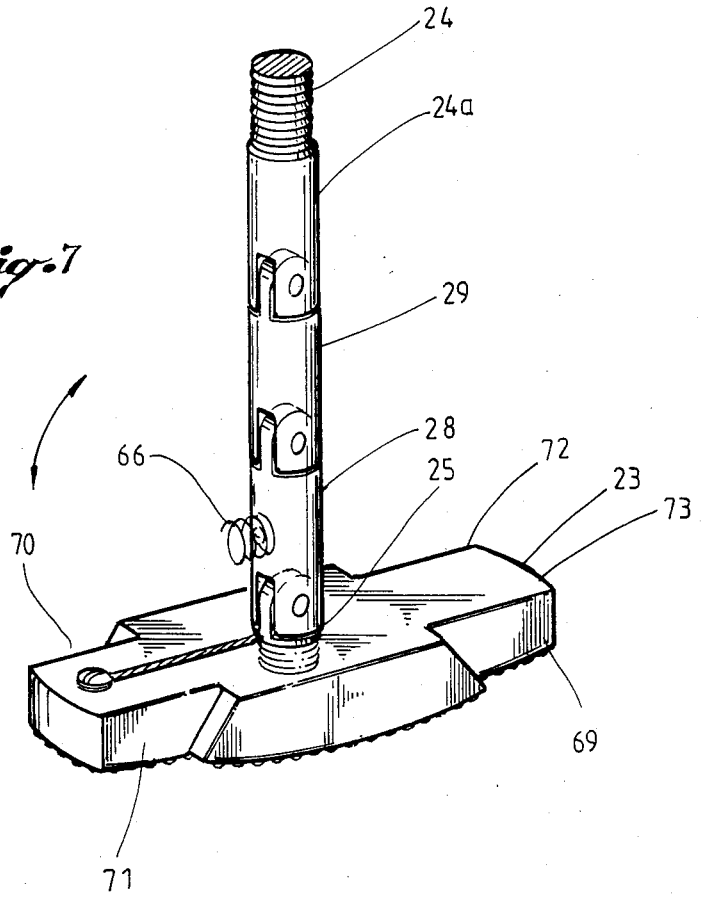
FIG. 7 is an elevational view of the drill bit, pivot device, offset mechanism, resilient means and a drill bit retention cable.

Before commencing drilling operations, wireline motor 52 and wireline 53 are withdrawn from drill pipe 21 and hollow tubular or cylindrical member 22. Withdrawal of the wireline motor 52 is accomplished by withdrawing the wireline in its conventional manner. During normal drilling operation drill string 21 is rotated thereby inducing a rotation of hollow tubular or cylindrical member 22 and imparting a rotation on bit receptacle 41 and bit 23. In the event drill string 21 is rotated in a clockwise manner (as viewed from the top looking down), the rotational forces are transferred from surfaces 69 and 70 to the matching bit receptacle surfaces (refer to FIGS. 7 and 8). In the event that rotation of the drill string 21 is made in a counterclockwise direction (as viewed from the top looking downward) the rotational forces are transferred by surfaces 71 and 72 to the matching bit receptacle surfaces.

Any forces tending to act in compression or upwards against bit 23 are transferred from top of bit 73 to the matching bit receptacle 41 surfaces.

A unique and innovative aspect of this downhole retrievable drill bit is that all rotational and drill bit compressive forces are transferred from the drill bit to the drill bit receptacle utilizing large cross-sectional areas, thereby reducing the load per unit area. The drill bit encompasses a significant amount of surface area for load transfer, thereby reducing the possibility of fatigue caused by forces of significant magnitude distributed over a very small surface area.

When it is determined by the rig operator that the drill bit 23 is dull, the drill string is lifted from the bottom of the borehole and the wireline motor 52 is lowered down drill string 21. Lowering of the wireline motor 52 may be aided by circulating drilling mud through the center of the drill string 21 thereby propelling the wireline motor 52 downward. The apex 38 and sloping walls 39 of the hollow tubular or cylindrical means 22 guides the wireline orienting and counterotation studs into slot or groove 37. Wireline operating shaft stud 49 is guided into slotted wireline attachment sleeve 44 by slotted wireline sleeve apex 44*a* and sloping sides 44*b* and 44*c*. As rotation of wireline motor shaft 51 begins in the counterclockwise direction (as viewed from the top looking downward), wireline shaft stud 49 interengages lifting and retrieval slots 50 on slotted wireline attachment sleeve 44. Rotation in the counterclockwise direction (as viewed from the top looking downward) of hollow rotating sleeve 44 causes bottom surface 46 of hollow rotating sleeve 44 to come in contact with end of assembly shaft stop 47. At the time surface 46 reaches the end of shaft stop 47, the assembly shaft 24 begins to rotate in a counterclockwise direction (as viewed from the top looking downward). This counterclockwise rotation unscrews threaded shaft 25 from threaded receptacle 26 (see FIG. 4).

Figure 4:
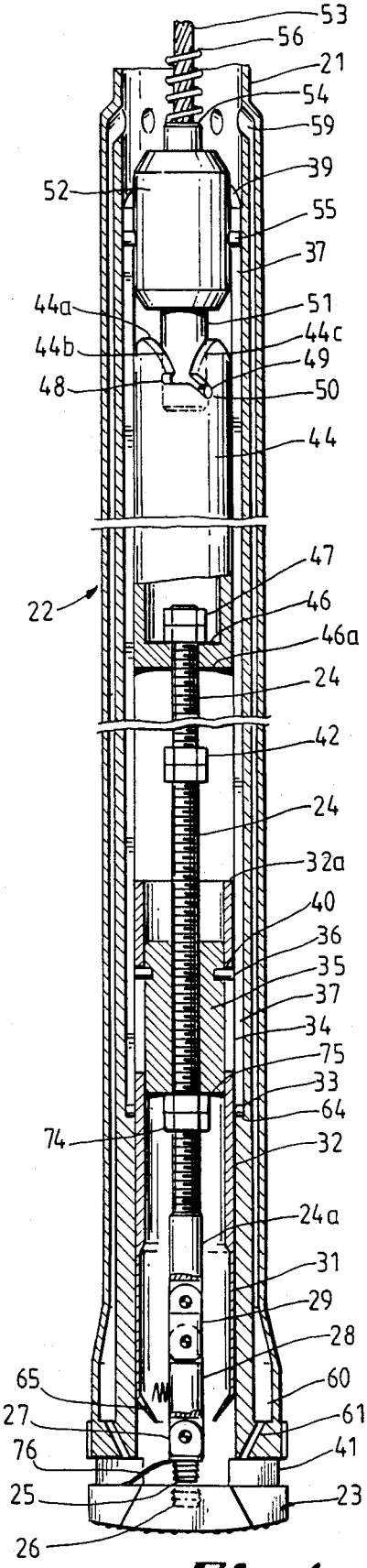
FIG. 4 is an elevational view, partially in section, of the downhole retrievable drill bit with the assembly shaft detached from the drill bit.

Referring to FIG. 4, the counterclockwise rotation of assembly shaft 24 continues until shaft stop means 74 jams against bottom surface 75 of threaded sleeve 35. When the end of shaft stop 74 comes in contact with bottom surface 75 of threaded sleeve 35, wireline motor 52 installs out indicating that unthreading of drill bit 23 has been completed. The completion of the unthreading operation may be detected by means of a microswitch in the bit receptacle. The microswitch status is sensed by a wireline carrier wires lowered with the wireline motor.

Figure 5:
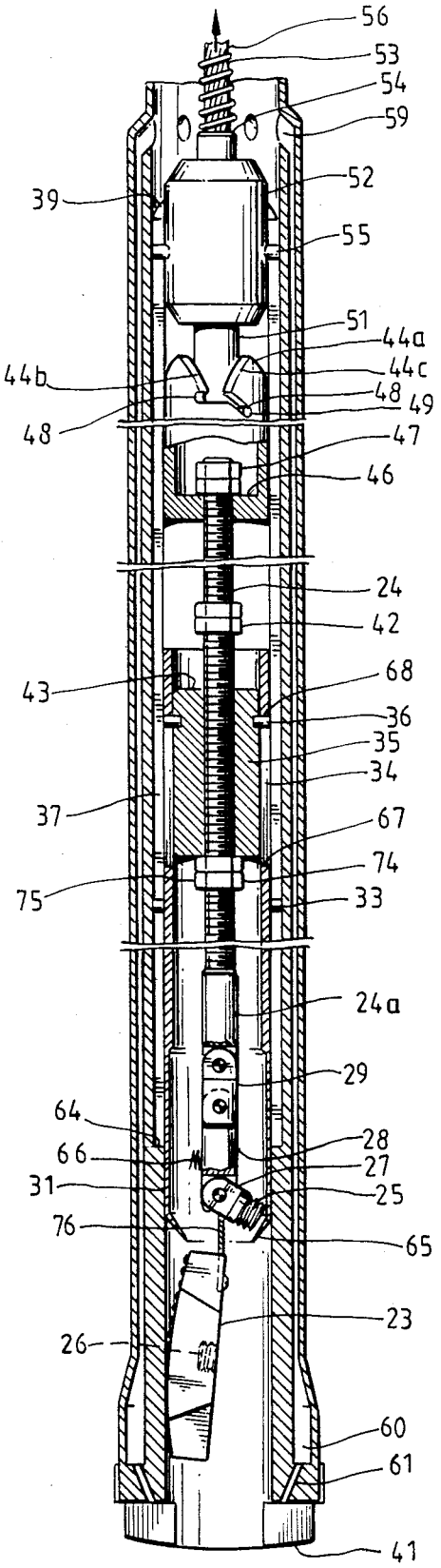
FIG. 5 is an elevational view, partially in section, of the downhole retrievable drill bit as the bit is raised from its normal drilling position.
Figure 6:
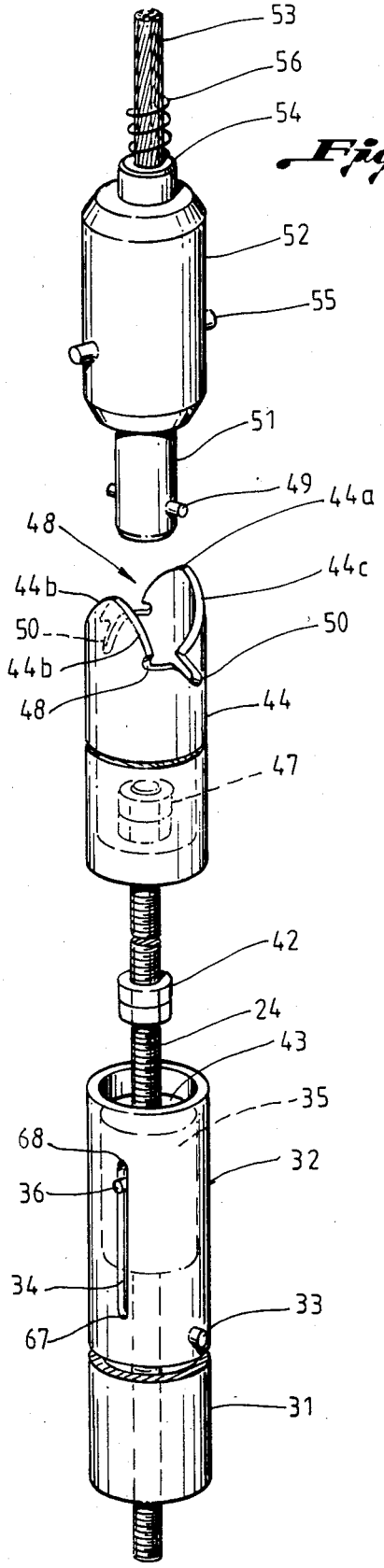
FIG. 6 is an isometric view of the wire line motor, slotted wire line attachment sleeve, downhole retrievable bit positioning mechanism, and a partial view of the assembly shaft.

Referring to FIG. 5, the downhole retrievable drill bit is viewed in the position as it is withdrawn utilizing wireline 53 to hoist the wireline motor 52, hollow rotating, sleeve 44, assembly shaft 24, drill bit positioning device 32, bottom of assembly shaft 24*a*, offset means 29, bottom of offset means 28, pivot device 27 and drill bit 23 out of hollow tubular member 22 and up through drill pipe 21. The retrieval of drill bit 23 is accomplished by means of cable 76 which is attached to pivot device 27 and drill bit 23. Withdrawal of the drill bit assembly and wireline motor is accomplished by withdrawing the wireline in its conventional manner.

After the above assembly is lifted out of the drill string 21 and drill bit 23 is replaced, drill bit threaded shaft 25 is interengaged into drill bit threaded receptacle 26. Drill bit 23 is also turned 90° from its normal operating position with the vertical axis of the upturned drill bit 23 offset from the centerline of assembly shaft 24. The drill bit is pushed upward past rubber tips 65 into the drill bit holding means consisting of the thinner walls section 31 of positioning device 32. Locking nuts 42 on assembly shaft 24 are prepositioned against the top surface 43 of threaded sleeve 35 to assure proper positioning and orientation of drill bit 23.

After the drill bit assembly has been prepared and prepositioned, wireline motor operating shaft stud 49 is interengaged and coupled with the lowering and positioning slots 48 of hollow rotating sleeve 44 and the entire assembly is lowered down drill string 21 and into the hollow tubular or cylindrical member 22. Lowering of the drill bit assembly through the drill string 21 and hollow tubular or cylindrical member 22 is partially aided by mud flow down through the center of the drill string 21. This flow of mud aids in pushing and assisting the downward travel of the drill bit assembly. Once in this position the entire process of sliding drill bit 23 out of the holding means 31 and into bit receptacle 41 is repeated.

The foregoing invention permits the removal of drill bit 23 without withdrawing drill string 21 and the hollow tubular or cylindrical member 22. This invention discloses a reliable means of replacing a drill bit without the time consuming round trip of withdrawing the drill string from the borehole. Additionally, this invention comprises a method whereby a sturdy one-piece drill bit 23 is effectively lowered down a drill string and through the hollow tubular or cylindrical member 22 to be properly prepositioned and oriented to assure proper placement in bit receptacle 41.

The above disclosure has been accomplished utilizing a righthand thread on the assembly shaft and all threaded surfaces. It is to be understood, however, that the same invention may be practiced with a lefthand threaded assembly shaft and threaded surfaces.

There has been provided in accordance with the present invention a downhole retrievable drill bit assembly which has been described in terms of a specific embodiment; however, many alternatives, modifications and variations will be apparent to those skilled in the art from the foregoing description. Accordingly, this disclosure is intended to embrace all such alternatives, modifications and variations that fall within the spirit and scope of the appended claims.

What is claimed is:

1. A downhole retrievable bit for use with a string of drill pipe in drilling a borehole which comprises:

(a) a unitary bit sized in a first lateral dimension to be raised and lowered in a first position within and along the drill string, said bit sized in a second lateral dimension to span in a second position the diameter of said borehole; said first and second dimensions being about 90° from one another;

(b) means to move said bit from said first position to said second position upon emergence of said bit from the lower end of said drill string; and (c) reversible interengaging means releasably locking said bit in said second position to the lower end of said drill string;

(d) said reversible interengaging means including means which releases said locked bit without relative rotation between the drill string and the bit.

2. A bit as defined in claim 1 including a means to suspend said bit from said reversible interengaging means upon release of said bit from said second position.

3. A bit as defined in claim 1 including a means to detect the proper orientation and placement of the drill bit.

4. A downhole drilling assembly for use with a drill string in drilling a borehole which comprises:

(a) a tubular sub adapted to be attached at its upper end to the lower end of said drill string, said sub being structured at its lower end to receive and hold a drill bit in a drilling position;

(b) a unitary drill bit with a drilling surface which has a first transverse dimension small enough to enable said bit to be raised and lowered within said drill string and said sub in a first position with the drilling surface of the bit substantially parallel to the axis of the tubular sub, and a second dimension substantially equal to the diameter of the borehole;

(c) a retrievable, reversible downhole motor adapted to be lowered within said drill string and sub to a position within said sub;

(d) a rod operatively coupled at its upper end to said motor and operatively coupled at its lower end to the body of said bit, the coupling to said bit being offset from the centerline of said sub and pivotal to enable said bit to move between said first position and a second position below said sub with the length of the drilling surface of said bit substantially normal to the centerline of the sub;

(e) bias means to partially urge said bit from said first position to said second position;

(f) interengaging means between said sub and said rod to orient said bit in said second position to be compatible with the bit receiving structure at the lower end of said sub;

(g) said downhole motor operable in a first rotational direction enabling said rod to urge said bit into said receiving structure, and operable in a second rotational direction to decouple said bit from said rod; and (h) a connector to suspend said decoupled bit from said rod.

5. A downhole retrievable drill bit for use with a drill string in drilling a borehole which comprises:

(a) a unitary bit body adapted to be pivotally suspended within the borehole;

(b) a cutting surface on said bit body which has a first linear dimension transverse to a second linear dimension which is small enough to enable said bit to be raised and lowered within the drill string and a second linear dimension substantially the same as the diameter of the borehole;

(c) reversible interengaging means releasably locking said bit in the drilling position at the lower end of the drill string; and (d) said reversible interengaging means including means which releases said locked bit without relative rotation between the drill string and the bit.

6. A drill bit as defined in claim 5, including bias means to urge said bit from a first position in which the linear dimension of the cutting surface is substantially parallel to the centerline of the drill string to a second position in which the linear dimension of the cutting surface is substantially normal to the centerline of the drill string.

7. A downhole retrievable drill bit for drilling a borehole comprising:

(a) a unitary drill bit sized in a first dimension to be lowered through a drill string at about 90° from its normal drilling position; said bit sized in a second dimension to span the borehole when in said normal drilling position;

(b) means for orienting, positioning and aligning said bit in its normal drilling position upon emergence from the lower end of the drill string;

(c) means for releasably locking said bit in said normal drilling position; and (d) said releasably locking means including means which releases said locked bit without relative roation between the drill string and the bit.

8. The downhole retrievable drill bit described in claim 7 wherein said drill bit orienting, positioning and aligning means includes positioning slots to orient the bit into its normal operating position.

9. The downhole retrievable drill bit described in claim 7 wherein said downhole drill bit orienting, positioning and aligning means includes a mud flow jacket.

10. The downhole retrievable drill bit described in claim 7 wherein said orienting, positioning and alligning means includes an assembly shaft and an offset mechanism operatively coupled to said assembly shaft.

11. The downhole retrievable drill bit described in claim 7 wherein said drill bit is threadedly attached to an assembly shaft and also by means of a flexible attachment means to aid in the retrieval of the bit.

12. The downhole retrievable drill bit described in claim 7 wherein said orienting, positioning and aligning means includes an assembly shaft with a slotted wire line attachment sleeve.

13. The downhole retrievable drill bit described in claim 7 wherein a microswitch detects the proper orientation and placement of the drill bit.

14. The downhole retrievable drill bit described in claim 7 further including a means to detect the proper orientation and placement of the drill bit.

15. A downhole retrievable drill bit comprising:

(a) a unitary cutting element adapted to be lowered within a drill pipe oriented approximately 90° from its normal drilling position, said cutting element having a first linear dimension substantially equal to the diameter of a borehole to be drilled, which said first linear dimension is substantially parallel to the axis of the drill pipe during such lowering;

(b) a downhole hollow cylindrical member attached to the lower end of the drill string;

(c) positioning slots in said hollow cylindrical member to orient said cutting element into its normal operating position;

(d) a threaded assembly shaft rotatably mounted within said hollow cylindrical member with its longitudinal axis substantially parallel to the center line of the hollow cylindrical member;

(e) drill bit positioning sleeve with positioning studs carried by said assembly shaft and fitting in said positioning slots;

(f) an offset mechanism pivotally mounted at one end to the lower end of said assembly shaft and at its other end to said cutting element;

(g) said cutting element biased to move from its position within said hollow cylindrical member to said normal drilling position;

(h) an annular mud flow path defined by the walls of said hollow cylindrical member;

(i) cutting element receptacle at the lower end of said cylindrical member to interengage said cutting element when said cutting element is in said drilling position; and (j) a flexible attachment means attaching said cutting element to said shaft.

16. The downhole retrievable drill bit described in claim 15 wherein a resilient means is attached to said bottom of offset mechanism.

17. The downhole retrievable drill bit described in claim 15 wherein the cutting element and assembly shaft form an upside down T-shaped member when the drill bit is in its normal operating position.

18. The downhole retrievable drill bit described in claim 15 wherein said cutting element receptacle includes mud flow slots in the outer circumference of the cutting element receptacle.

19. The downhole retrievable drill bit described in claim 15 wherein the proper operating position of the cutting element is detected by a microswitch.

20. The downhole retrievable drill bit described in claim 15 wherein said cutting element receptacle supports the top and sides of said cutting element during drilling operations.

21. The downhole retrievable drill bit described in claim 15 wherein said cutting element receptacle is dimensionally configured to tightly receive said cutting element.

22. A downhole retrievable drill bit for drilling a bore-hole comprising:

(a) a hollow cylindrical means attached to the lower portion of a tubular drive means with;
  (i) drill bit positioning means,
  (ii) mud flow jacket,
  (iii) drill bit recptacle,
  (iv) mud flow ports on the face of said bit receptacle,
  (v) mud flow slots on the outer circumference of said drill bit receptacle,
  (vi) attachment means for attachment to the lower end of the drill string, (b) a drill bit positioning and retention device with;
  (i) hollow longitudinal tube means,
  (ii) drill bit positioning studs,
  (iii) longitudinal slots,
  (iv) threaded sleeve sized to fit within said hollow longitudinal tube means,
  (v) counterrotation studs on said threaded sleeve interengaging said longitudinal slots,
  (vi) flexible members at the bottom of said drill bit positioning and retention device, (c) a threaded assembly shaft with;
  (i) end of shaft stop,
  (ii) drill bit pre-positioning means,
  (iii) shaft stop means,
  (iv) bottom of threaded shaft assembly,
  (v) drill bit offset means,
  (vi) bottom of drill bit offset means,
  (vii) pivot device, and
  (viii) drill bit attachment means, (d) a drill bit attached to said drill bit attachment means in its normal operating position and during drill bit lowering operation;

(e) an attachment means to raise the drill bit from its normal operating position after it has been decoupled from said assembly shaft;

(f) a hollow cylindrical wireline attachment sleeve threadedly engaging said threaded assembly shaft with;
  (i) a threaded bottom,
  (ii) slots for interengaging a wireline motor operating shaft, (g) a wireline motor with;
  (i) wireline attachment point,
  (ii) wireline motor orienting and counter-rotation studs interengaging said drill bit positioning means of said hollow cylindrical means, and
  (iii) wireline motor operating shaft interengaging the said attachment sleeve slots.

23. The downhole retrievable drill bit described in claim 22 wherein a resilient compressible member is attached to said bottom of offset mechanism.

24. The downhole retrievable drill bit described in claim 22 wherein the said drill bit is threadedly interengaged to said drill bit attachment means.

25. The downhole retrievable drill bit described in claim 22 wherein the drill bit and assembly shaft form an upside-down T-shaped member with the drill bit in its normal operating position.

26. The downhole retrievable drill bit described in claim 22 wherein the proper operating position of the drill bit is detected by a microswitch.

27. The downhole retrievable drill bit described in claim 22 wherein the attachment means used to raise the drill bit from its normal operating position is a flexible cable.

* * * * *